US006223671B1

(12) United States Patent
Head

(10) Patent No.: US 6,223,671 B1
(45) Date of Patent: May 1, 2001

(54) MOORING SYSTEM

(76) Inventor: Philip Head, 178 Brent Crescent, London (GB), NW10 7XR ( * ) Notice: Subject to any disclaimer, the term of this patent is extended or adjusted under 35 U.S.C. 154(b) by 0 days.

(21) Appl. No.: 09/362,588

(22) Filed: Jul. 28, 1999

(30) Foreign Application Priority Data

Jul. 29, 1998 (GB) ..... 9816486
Aug. 20, 1998 (GB) ..... 9818230

(51) Int. Cl.[7] ..... B63B 21/00
(52) U.S. Cl. ..... 114/230.2; 114/295
(58) Field of Search ..... 114/293, 294, 114/295, 296, 230.1, 230.2; 441/3

(56) References Cited

U.S. PATENT DOCUMENTS

| | | | | |
|---|---|---|---|---|
| 3,646,598 | * | 2/1972 | Chelminski | 114/295 |
| 3,786,525 | | 1/1974 | Christians . | |
| 3,910,218 | | 10/1975 | Taylor . | |
| 4,312,289 | * | 1/1982 | Conrad | 114/295 |
| 4,318,641 | | 3/1982 | Hogervorst . | |
| 4,356,788 | * | 11/1982 | Stern et al. | 114/295 |
| 5,431,219 | * | 7/1995 | Leising et al. | 166/50 |
| 5,671,811 | * | 9/1997 | Head | 166/346 |
| 6,066,015 | * | 5/2000 | Brown | 114/295 |

FOREIGN PATENT DOCUMENTS

| | | | | |
|---|---|---|---|---|
| 325836 | * | 2/1930 | (GB) | 114/295 |
| 1 249 548 | | 9/1969 | (GB) . | |

* cited by examiner

*Primary Examiner*—Stephen Avila
(74) *Attorney, Agent, or Firm*—Herbert Dubno

(57) ABSTRACT

A mooring apparatus for securing a mooring line for a floating rig or the like, includes a soil penetration means, an anchoring means, and coiled tubing or the like, the soil penetration means and anchoring means being arranged upon the coiled tubing. Fluid may be pumped down the coiled tubing to drive the soil penetration means, or to activate the anchor. A transmission cable, to control the mooring system or supply it with power, may also be disposed along the coiled tubing. Various penetration means, such as drill and helical augers may be used. For soft soil, the soil penetration means may include nozzles to erode the soil. The soil penetration means may either be retracted, of sacrificed to form part of the anchor. The anchor may then be fixed securely by supplying concrete or the like down the coiled tubing and into the hole. The mooring apparatus includes a buoy, releasable by remote signals. Also disclosed is a mooring apparatus which anchors itself by changing it's profile in the soil, by, for example, inflating, or opening up like an umbrella.

14 Claims, 12 Drawing Sheets

136
130
30
132
134

136
30
132
130
134

132

36
140
30
132
134
130

36
140
30
132
130
134

136
140
138
130
132
134

140
142
136
134
133
132
143

145
147
148
136
143

152
145
147
148
136
143

152
145
147
148
136
143

MOORING SYSTEM

FIELD OF THE INVENTION

The present invention relates to mooring systems, particularly those for use with floating rigs.

BACKGROUND OF THE INVENTION

When laying anchors for a rig in the conventional manner, a supply vessel tows the anchor, chains, and sometimes a polyester mooring line as far out from the rig as possible. The anchor is then dropped, and when it has reached the seabed the rig uses winches to pull upon the anchor by the mooring line. Hopefully the anchor gets a grip and buries itself in the seabed helped by the weight of the chain and the angles of the anchor's blades, however this process can be very laborious and time consuming, Two opposing mooring lines have to be deployed before they can be tensioned and tested. If one anchor has failed to become embedded, it must be retrieved and re-laid. It can take a rig sometimes seven days or longer to achieve a secure mooring position.

OBJECTS OF THE INVENTION

The object of the present invention is to provide a means for quickly and easily securing an anchor for a mooring line upon the seabed, with less chance that the anchor point will not be property embedded.

A flier object of the present invention is to provide a means of applying further treatments to the anchor upon the seabed in order to ensure that it is more reliably secured.

SUMMARY OF THE INVENTION

According to the present invention there is provided a mooring apparatus for a mooring line for a floating rig or the like, including a soil penetration means, and an anchoring means, the mooring apparatus being lowered upon coiled tubing or the Like.

The soil penetration means, and the anchoring means activation, may powered by fluid, which may be supplied via the coiled tubing. A transmission cable may be disposed along the coiled tubing.

The soil penetration means may include a helical element which screws into the seabed Preferably there is included a mooring line or a guide line for a mooring line, this line being partly releasably attached to the anchoring means. Preferably a buoy device stores the line and a buoy for releasing the line when needed. The buoy may be released by an remote signal.

The anchoring means may be able to alter its profile and/or shape. To this end, the anchoring means may include inflatable members.

According to another aspect of the present invention there is provided a method of forming an anchor point including deploying a mooring apparatus as described above.

Preferably the anchoring means includes a pulley and a guide line by which a larger mooring line may be brought to the anchoring means. Preferably the mooring line includes an latching element and the anchoring means includes a corresponding mating part.

The anchoring means may include a buoy device which stores a line (whether a guide line or a mooring line) for mooring to the anchoring means and a buoy for releasing the line when needed. Preferably this buoy is released by an remote signal.

A major advantage of using coiled tubing is that the anchoring means can be drilled to a depth where its mechanical strength is sufficient to retain it, if necessary hundreds of meters into the seabed. The coiled tubing can also be used to deliver power to penetration means or anchoring means, and to protect transmission cables if used. The coiled tubing may also be used to inject a suitable bonding material such as cement around the anchor to lock the anchor in place once set to the required depth.

The mooring apparatus may also be equipped with additional apparatus in order to further secure the anchor to the seabed if desired. Preferably the securement members' change of profile should be reversible so that the mooring apparatus may be retrieved when it is no longer needed at its initial position.

Where the mooring apparatus is capable of altering its shape, it may be driven into the seabed in a state in which its drag or friction against the material of the seabed is low, and then switched such that its drag is increased to such an extent that the mooring apparatus is firmly embedded in the seabed An important method disclosed herein of increasing the drag of the mooring apparatus is to increase the area of the apparatus perpendicularly to the direction of pull from the mooring line. Increased drag may also be achieved through altering the fluid/viscous dynamic qualities of the shape, so that the apparatus tends to catch the material of the seabed in front of it. The use of the word aerodynamic here is in the loosest sense, that is, it refers to the resistance of the mooring apparatus through the material of te seabed in a particular direction.

BRIEF DESCRIPTION OF THE DRAWING

Mooring systems embodying the invention will now be described, gives as examples and not intended to be limiting, with reference to the drawing, of which.

SPECIFIC DESCRIPTION

Figure 1:
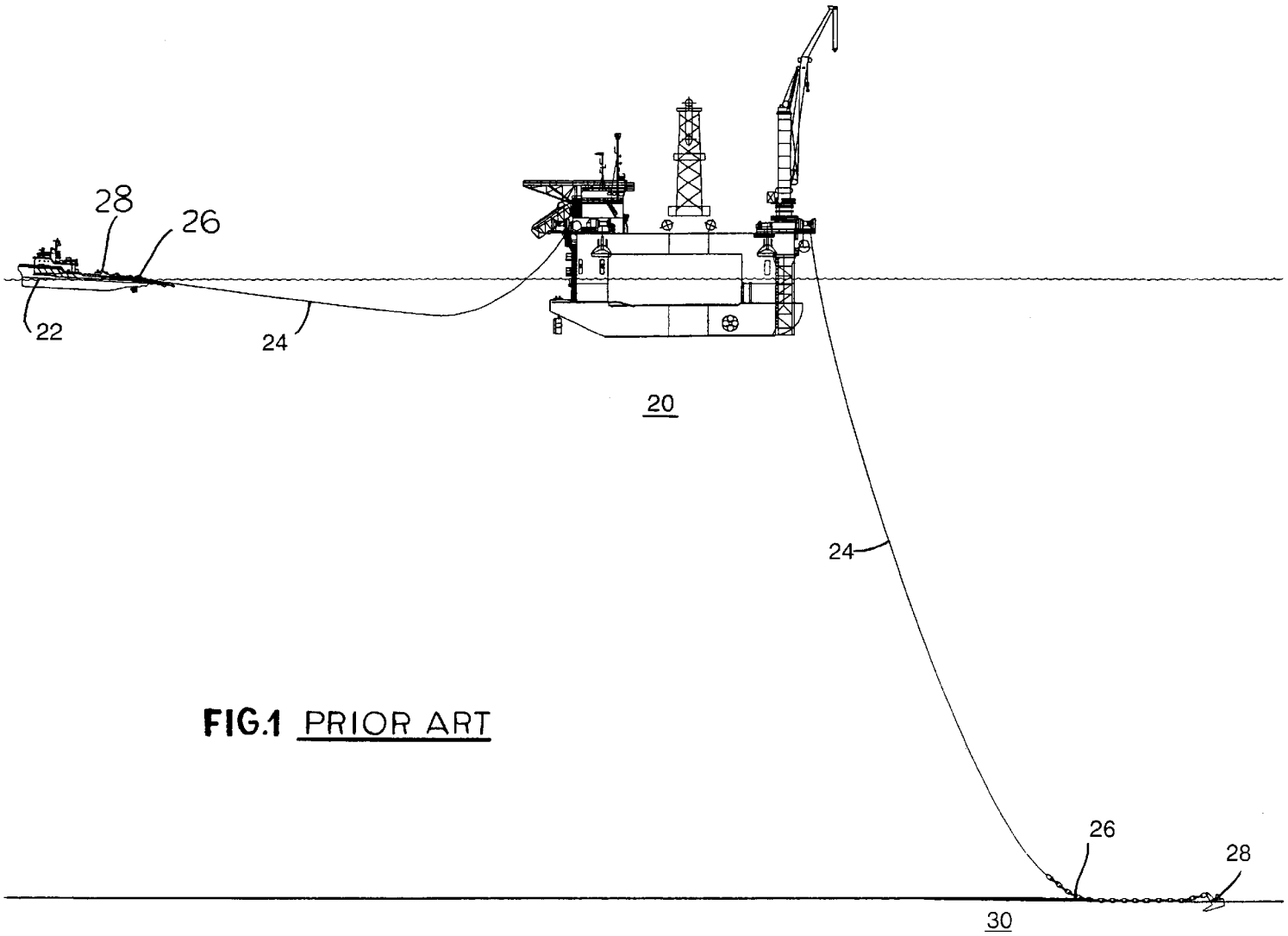
FIG.1 PRIOR ART
FIG. 1 shows the prior art method of securing anchor points.

A known method of securing a floating rig 20 is shown in FIG. 1. A supply vessel 22 carries an anchor 28 as far from the rig as the mooring line 24 will allow. The anchor, and its heavy chain 26, are dropped from the vessel and allowed to fall to the seabed. When the anchor has reached the seabed, winches upon the rig pull upon the mooring line 24, and the anchor is dragged along the seabed. Its weight, and the angle at which its blades are set, are designed to cause it to become embedded in the seabed. If the anchor fails to become embedded, it must be completely raised, and reloaded onto the supply vessel to repeat the process.

Figure 2:
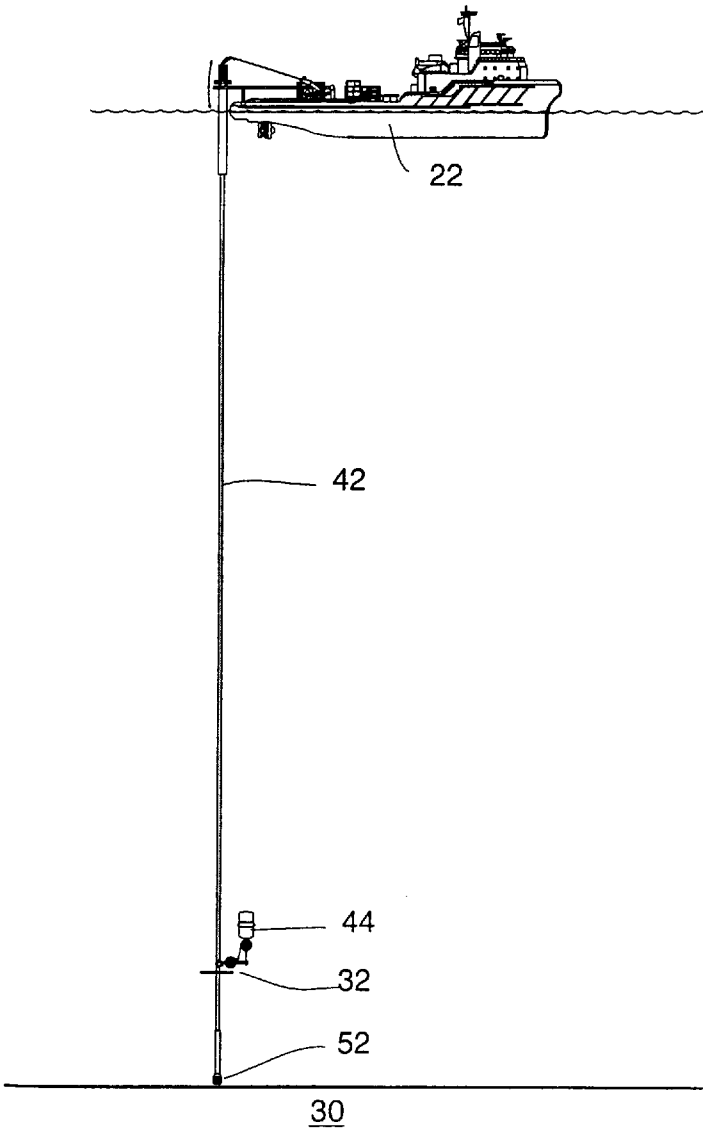
FIG. 2 shows an embodiment of the invention being deployed from a vessel.

FIG. 2 shows a mooring apparatus 32 being deployed on coiled tubing 42 from the back of a supply vessel 22. The coiled tubing injector is mounted on a heave compensated deck of a supply vessel and the coiled tubing is used to supply power to a motor on the mooring apparatus 32 which drives a drill bit 52 placed at its end, and so drill the anchor into the seabed 30.

In this instance the supply vessel may be setting anchor points several weeks before the semi rig arrives on location. This presents another problem as the guide line used to pull in the mooring line needs to be attached to the anchor point, however it needs to kept out of the way of the water surface for fear of being tangled or lost. A solution to this problem is to store the guide line on a reel and buoy device 44, which is attached to the anchor 32 by a releasable device. When the rig arrives on location, a sonic transmitter activates the release mechanism, this allows the buoy to float to surface, this in turn carries the reel and guide line to the surface, while its lower end is still attached to a pulley wheel on the anchor 12. Once at the surface a supply vessel can collect the buoy and cable and transport the guide line back to the rig for the mooring line to be pulled out to the anchor.

Figure 4:
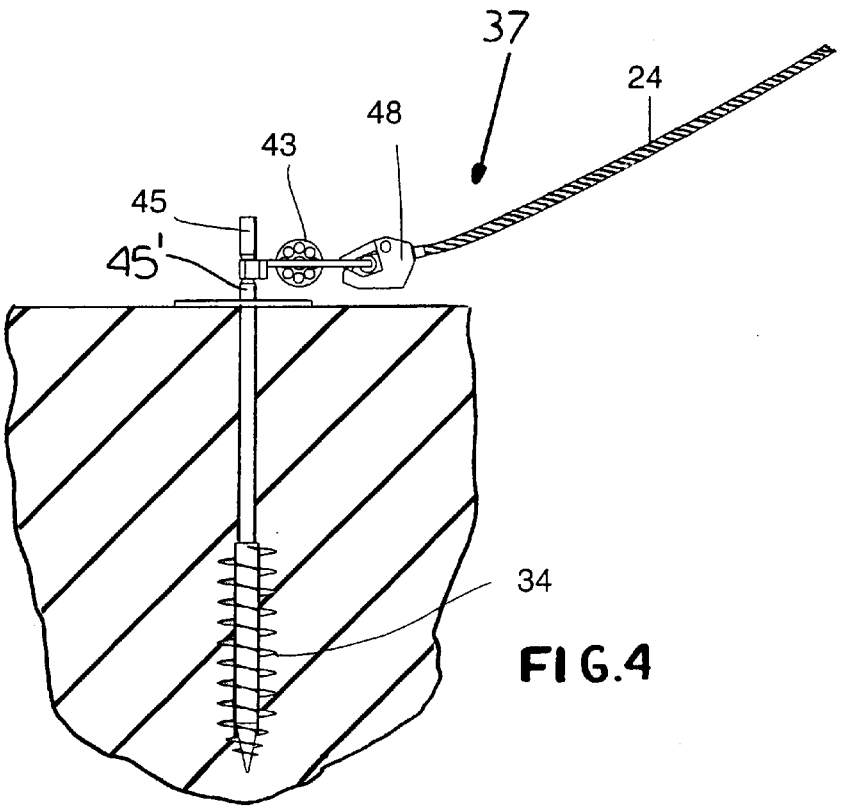
FIG. 3 and FIG. 4 show another embodiment and the process of securing the to the anchor point.
Figure 3:
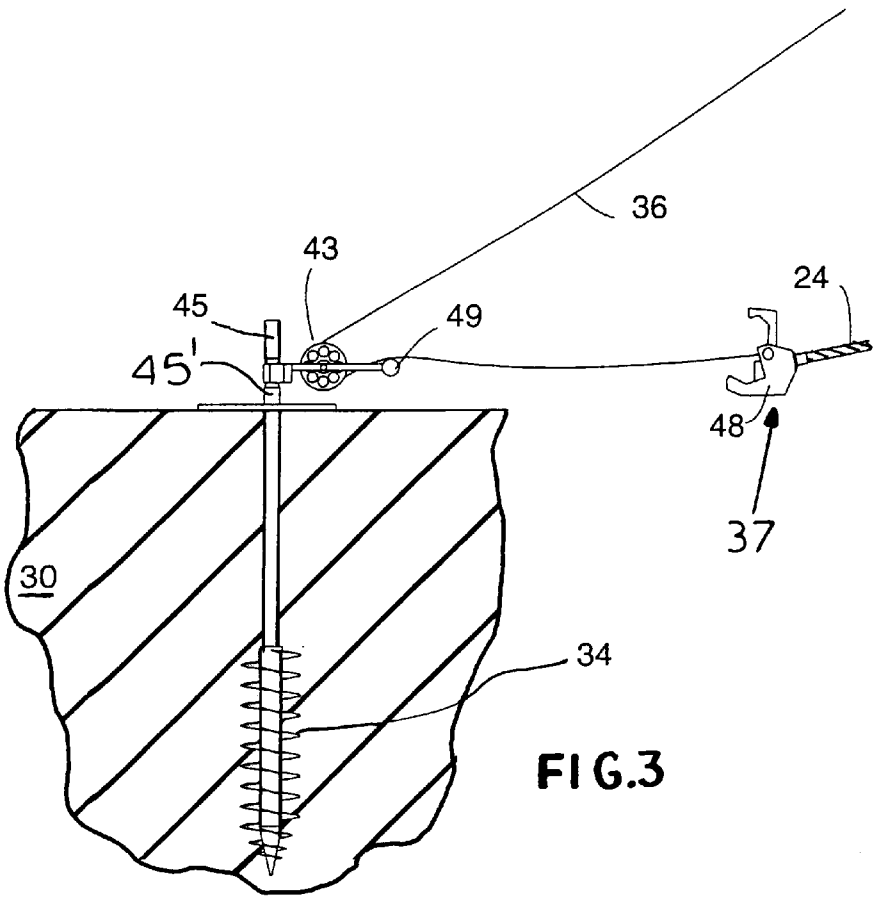
Figures 5, 6, 7, 8:
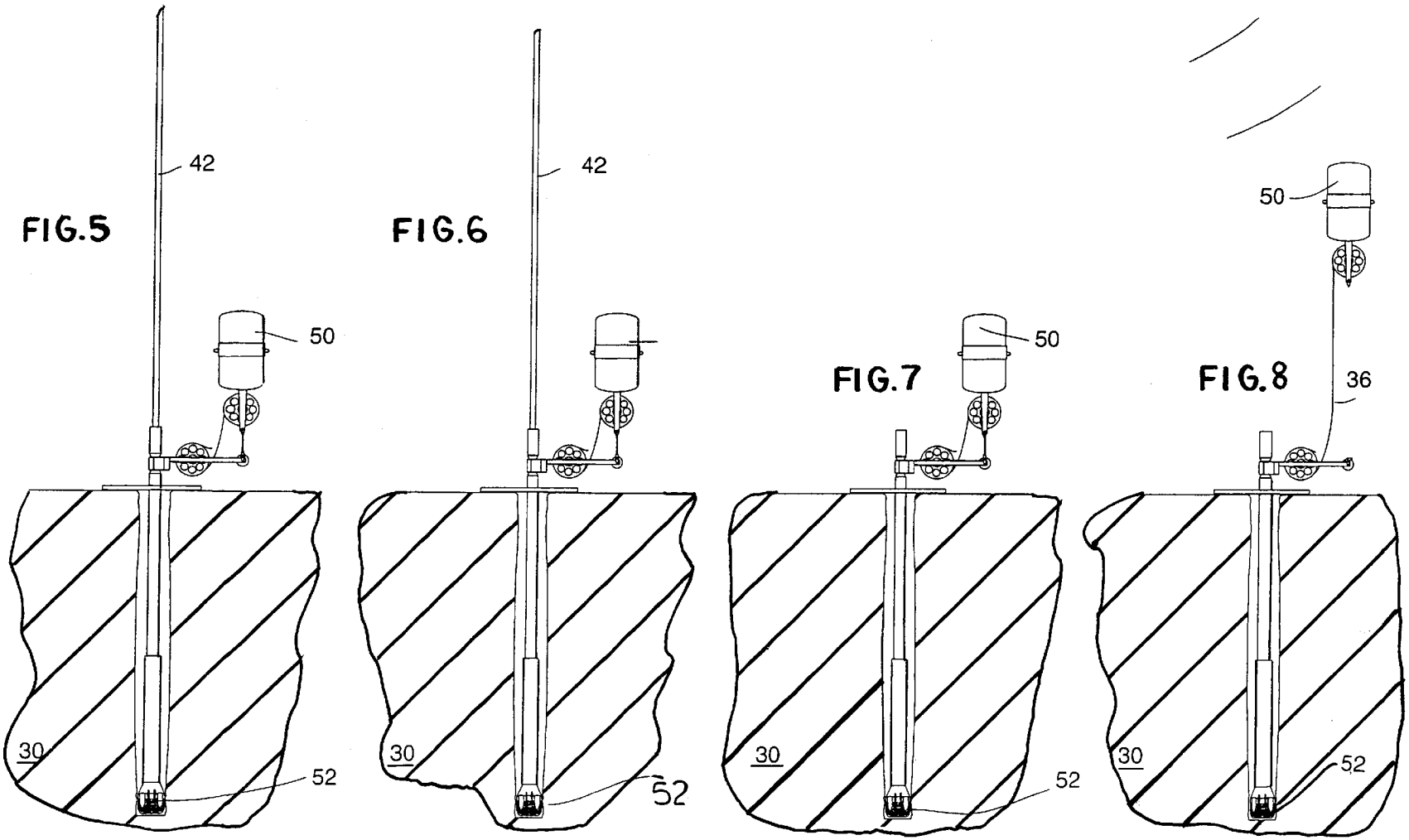
FIG. 5 and FIG. 9 show a further embodiment during operation.

Referring to FIGS. 3 and 4, the guide line 36 is connected to a pulley 43 mounted on the post of the anchor 45', and goes all the way back to the semi rig, and can now be used to pull out the mooring line 37. The mooring line has a resetable auto-closing latch 48 which once engaged to the mating profile 49 on the anchor closes and secures the mooring line to the anchor point, This auto-closing latch can be released at any time by the rig to allow the mooring line to be retrieved back to the rig.

FIGS. 3 and 4 also show an alternative soil penetration means, comprising a helical auger 34 driven by an electric motor 45. The helical auger is then forms the anchor for the mooring line.

Figure 9:
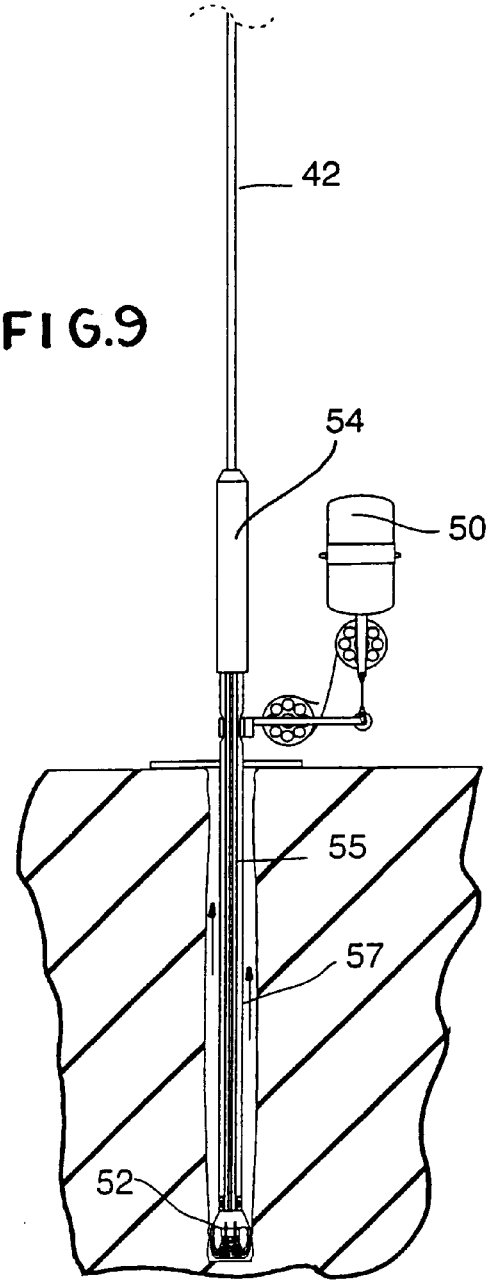

FIGS. 5 to 9 show another embodiment of the invention, in this example the anchor point is drilled into the seabed using coiled tubing 42 and a motor driving a drill bit 52. The motor could electric powered, hydraulically powered, driven by a rotating shaft inside the coiled tubing or driven by fluid pumped down the coiled tubing from the supply vessel. The cable supplying the motor is disposed inside the coiled tubing. The preferred position of the motor 54 on the mooring apparatus is shown in FIG. 9, the motor rotating a shaft 55 running down to the drill bit 52 through a hollow housing 57. The drill bit may be removed before a pile is inserted, or left in the hole to form part of the anchor. One advantage of this is that the mooring apparatus can be set in the ground to a much greater depth (hundreds of meters). Once at the required depth setting material such as cement can be pumped down the tubing and the anchor set permanently into the sea bed.

As this would typically be performed from the back of a service vessel, the small guide line 36 which goes back to the rig may not be required for several weeks. Therefore to keep it out of harms way it can be stored an a reel mounted below a buoy 50 attached to the anchor via a connection releasable with an ultrasonic signal from surface. Once the buoy is activated, it floats to surface leading the guide line behind it.

Figure 10:
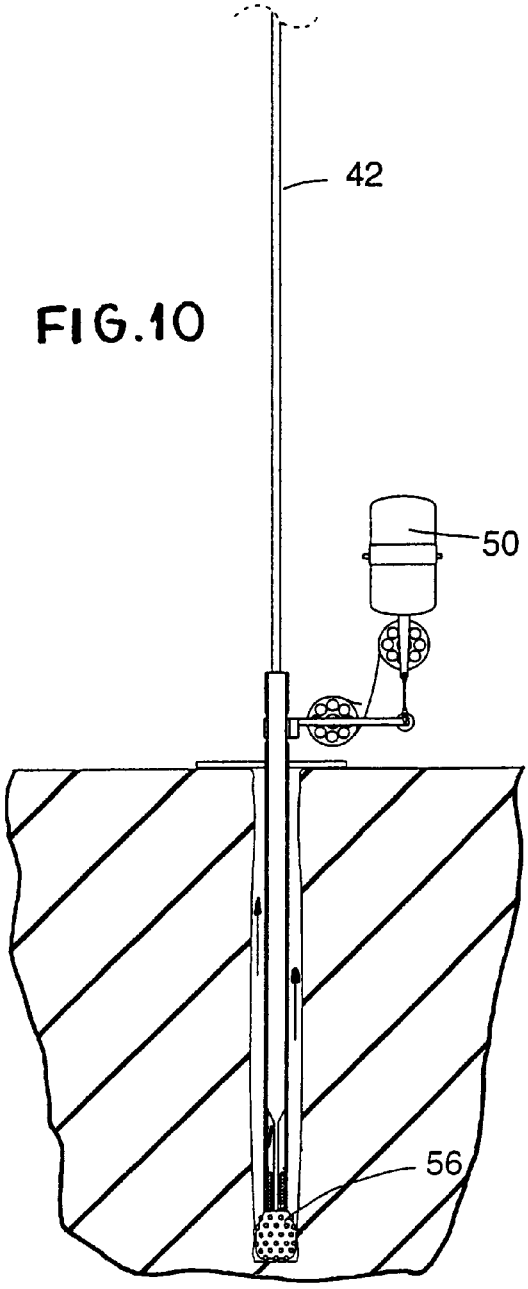
FIGS. 10 to 12 show further embodiments.
Figure 11:
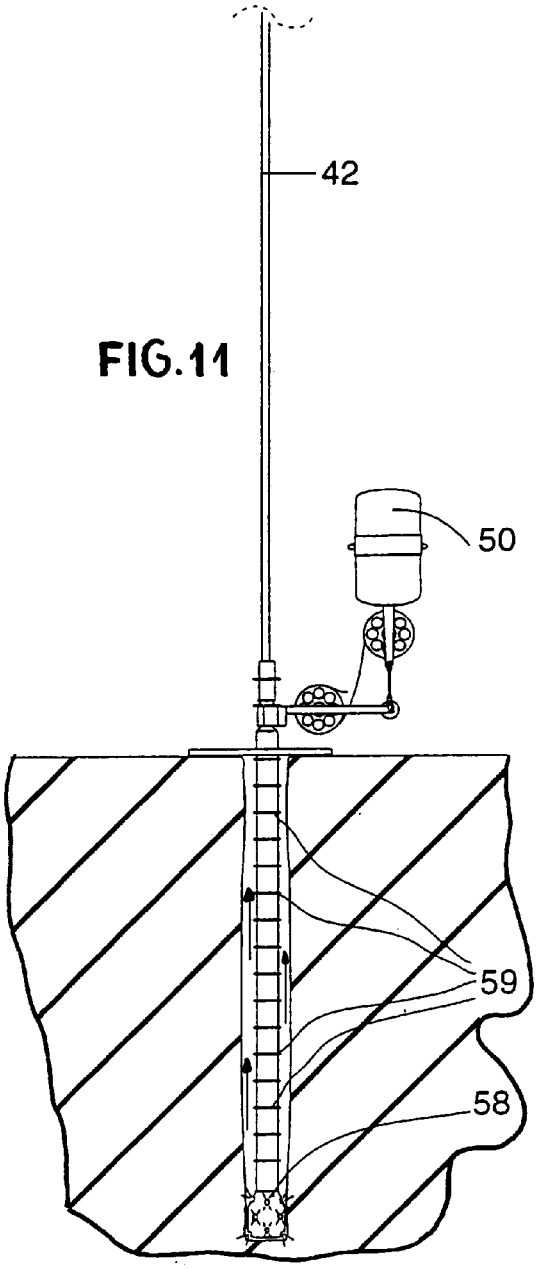

Referring to FIG. 10 the drill bit could incorporate a percussive element 56 to aid the penetration of the seabed. Referring to FIG. 11, a further alternative method of penetrating the seabed is to use a jetting tool 58, through which an abrasive fluid is pumped at high pressure to widen and deepen the hole. The embodiment in FIG. 11 also includes horizontal annular projections 59 to gain additional purchase upon cement pumped into the hole.

Figure 12:
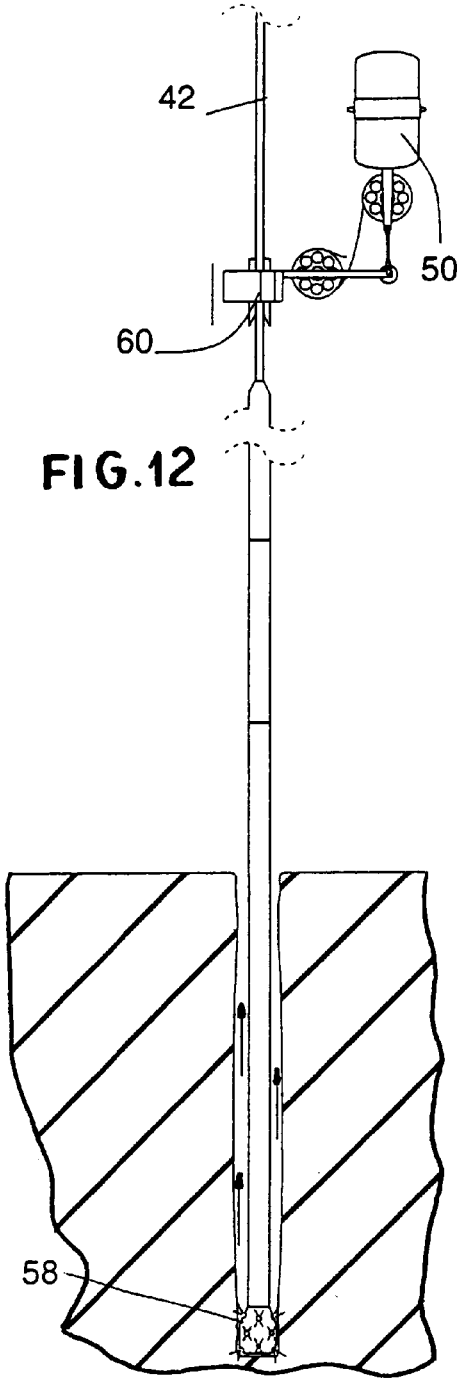

Referring to FIG. 12, the anchor may be extended by allowing hollow sections to be added to the coiled tube so as to drop down onto the previous section and become attached. The buoy and pulley mechanism 50 may be lowered upon a ratchet mechanism 60 upon the coiled tube 42 to come to rest upon the uppermost section.

In the embodiments so far described the soil penetration means remains in the seabed to form the anchor, The soil penetration means can also be withdrawn after forming a hole, and a dedicated anchor inserted into this hole. The soil penetration means can then be retrieved. Retrievable drill bits cn be used for the soil penetration means, so that the lower pipe of the drill remains to form the anchor while the drill bit itself is withdrawn up through the pipe and brought to the surface to be reused to form other anchor points.

Referring to FIGS. 13 to 16, an alternative embodiment of the mooring apparatus comprises a mooring post 130, and securement members 132 which include nozzles 134, the mooring post including attachment means for securing a mooring line 136 to the mooring apparatus. Channels and valve means are included to supply and control fluid to the securement members and the nozzles.

To embed the mooring apparatus in the seabed, it is suspended upon coiled tubing 140 mounted upon a supply vessel, and lowered to the seabed. The mooring line 136 is attached to the top of the mooring post 130 by some attachment means such as clips which link together. When the seabed has been reached, a fluid, most conveniently water, is supplied to the mooring apparatus through the coiled tubing. The water flows through the channels and the valve means to the nozzles 134, were the water is expelled to erode the material of the seabed beneath the mooring apparatus. The mooring apparatus is lowered into the resulting hole, whilst the nozzles continue to operate, so that a shaft is formed into which most of the mooring apparatus sits, with only a small portion of the mooring post extending upwards from the seabed.

At this point the valve means reduce the flow of water to the nozzles, so that pressure behind the nozzles, that is, in the securement members increases. The securement members are composed of a membrane which is somewhat flexible. Though the flow of water through the nozzles is reduced, material continues to be carried away from the cavity in which the mooring apparatus is in, and the increased water pressure causes them to inflate to fill the available space.

Figures 13, 14, 15, 16, 17:
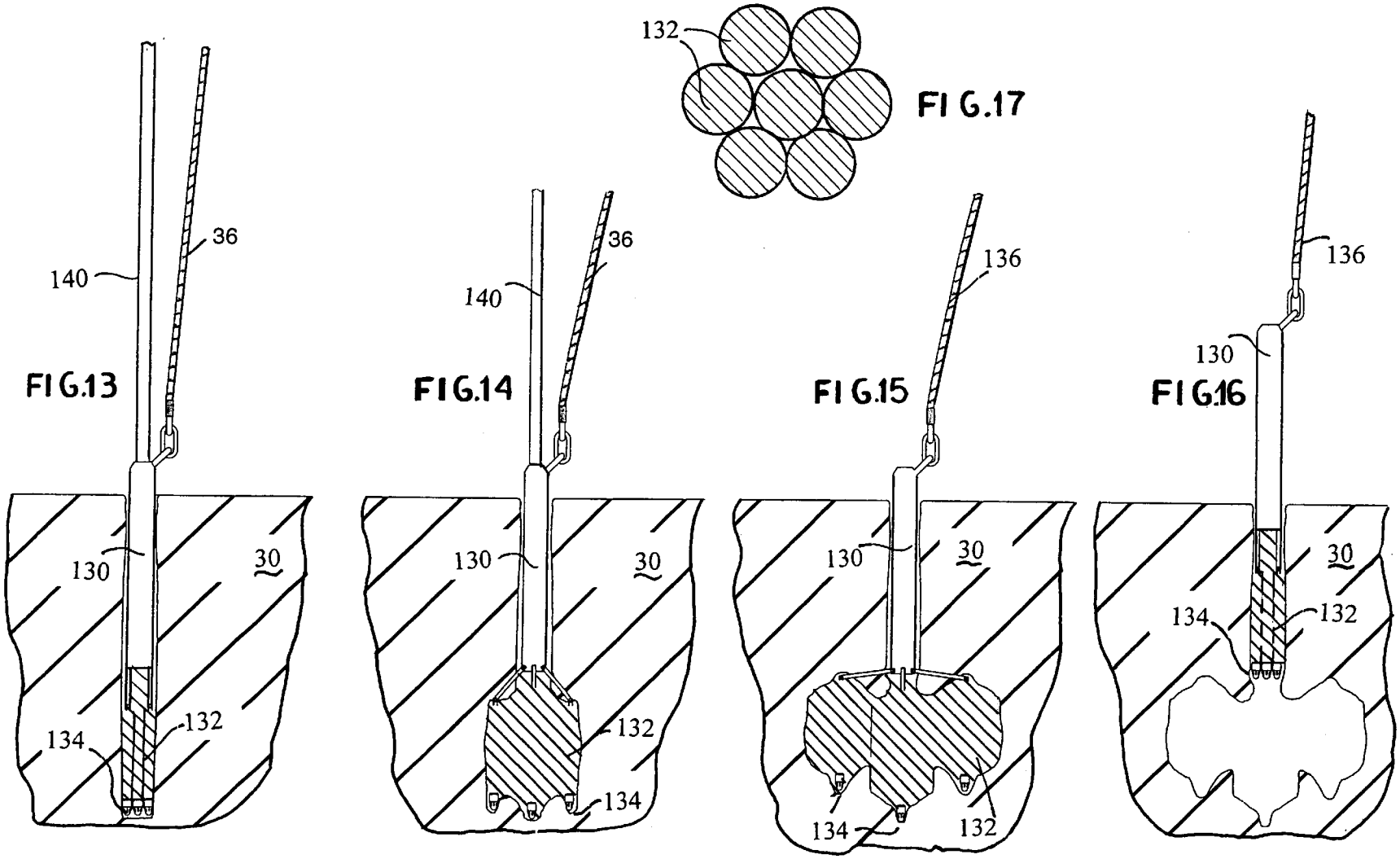
FIGS. 13 to 16 show a further embodiment in operation.
FIG. 17 is a top view of the securement members of this embodiment.

Referring to FIG. 17, there arc seven securement members 132 in all, each being circular in plan when filly inflated, and they are arranged with one securement member surrounded by six others in a hexagonal arrangement. The profile presented by the inflated securement members means that the mooring apparatus is anchored by the weight of earth above the securement members.

The valve means may be operated by allowing a ball bearing to drop into each nozzle at the appropriate time in order to inhibit the flow, or some other valve mechanism such as a valve operated by a signal from a cable from the surface, or by sensors indicating that the correct depth has been reached.

After the securement members are fully inflated, the valve means close both the securement members' nozzles and the channel in the mooring post supplying the securement members with water. The coiled tubing 140 is now disconnected, leaving the mooring apparatus embedded firmly in the seabed, and ready to have loading applied to the mooring line 136.

When the mooring apparatus is no longer needed in a particular spot, it may be retrieved to be reused. A signal is transited, for example by sonic pulses, to the valve means causing it to open all the valves. The material of the securement members is somewhat resilient, and the securement members expel the water inside them and deflate to their initial shape. The securement members' profile is now sufficiently narrow to allow the members to pass back up the shaft as the mooring line pulls upon the mooring apparatus.

Another embodiment is shown in FIGS. 18 to 21. A supporting frame 142, its apex attached to the coiled tubing, helps keep the coiled tubing and the mooring apparatus perpendicular to the seabed. Ideally, the supporting frame will be three dimensional in nature, so that it comprises the triangular shape shown in FIGS. 18 and 19 in one plane, and a similar triangular shape (not here shown) in a vertical plane at right angles to the first, that is, going in to and coming out of the page as the mooring apparatus is here represented.

The mooring apparatus is lowered, like the previous embodiments, upon coiled tubing, and similarly a mooring line is connected to the mooring post by attachment means. Whilst the mooring apparatus is being lowered, the nozzle expels water to erode a shaft in the same manner as in the previous embodiment.

A single securement member 132 ends in a nozzle 134. The securement member in this embodiment resembles an upturned umbrella, that is, the securement member is initially closed and is similar to a cylinder, having a diameter much the same as the mooring post, but in its open position has a pyramidal form, its apex being lowermost.

When the mooring apparatus has been lowered to the required depth, the valve means associated with the nozzle 134 fully or partially closes the water supply to the nozzle, and causes the supply to be diverted to securement member so that it opens to its pyramidal form. The means causing the securement member could be an inflatable device within the securement member. The securement member could also be equipped with nozzles to assist its movement through the seabed material.

When the securement member is filly open, the coiled tubing may be disconnected from the mooring apparatus and the coiled tubing and supporting frame winched to the surface. Not only does the securement member of the mooring apparatus present a large profile perpendicular to a force pulling upon the mooring line, the unstreamlined shape ensures that it is difficult to drag through the seabed material.

Figures 18, 19, 20, 21:
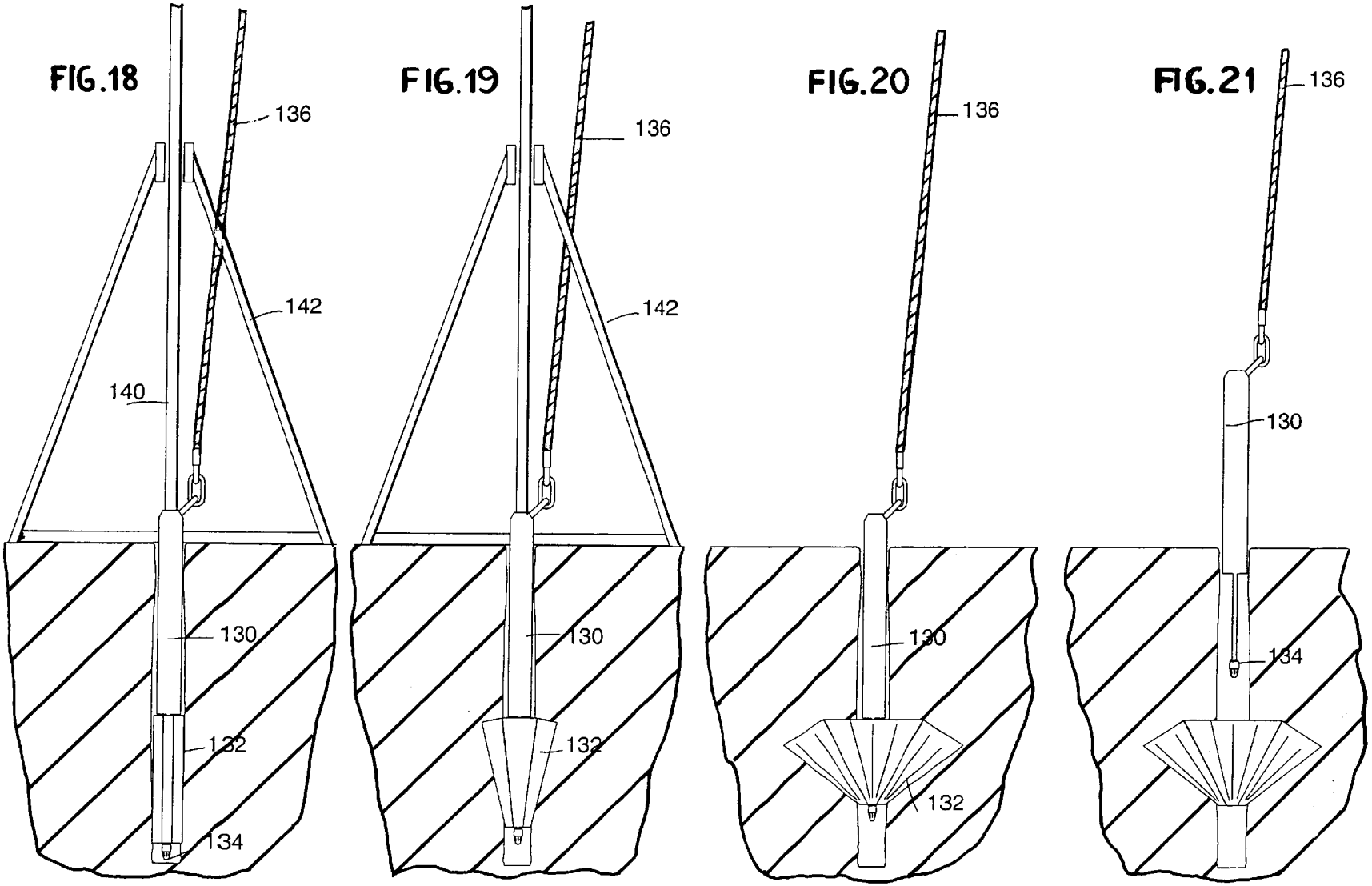
FIGS. 18 to 21 show a further embodiment is operation.

It may be that it is not possible to close the securement member when the mooring point is no longer required and the mooring apparatus is to be retrieved. When this occurs, the securement member may be detached from the mooring post upon a signal being received, by sonic pulses or through a cable attached to the mooring line for example, as shown in FIG. 21.

FIGS. 22 to 25 show a further embodiment, which is lowered to the seabed by coiled tubing 140, and then lowered further into a shaft created by a nozzle 134 at the bottom of the securement members 132, whilst kept vertical by a supporting frame 138. The securement means comprises three rods, the central rod being fixed vertically, but capable of axial rotation, and two outer rods, hinged with the central rod at approximately its midpoint, which initially lie adjacent and extend downwards to the end of the central rod.

Figures 22, 23, 24, 25:
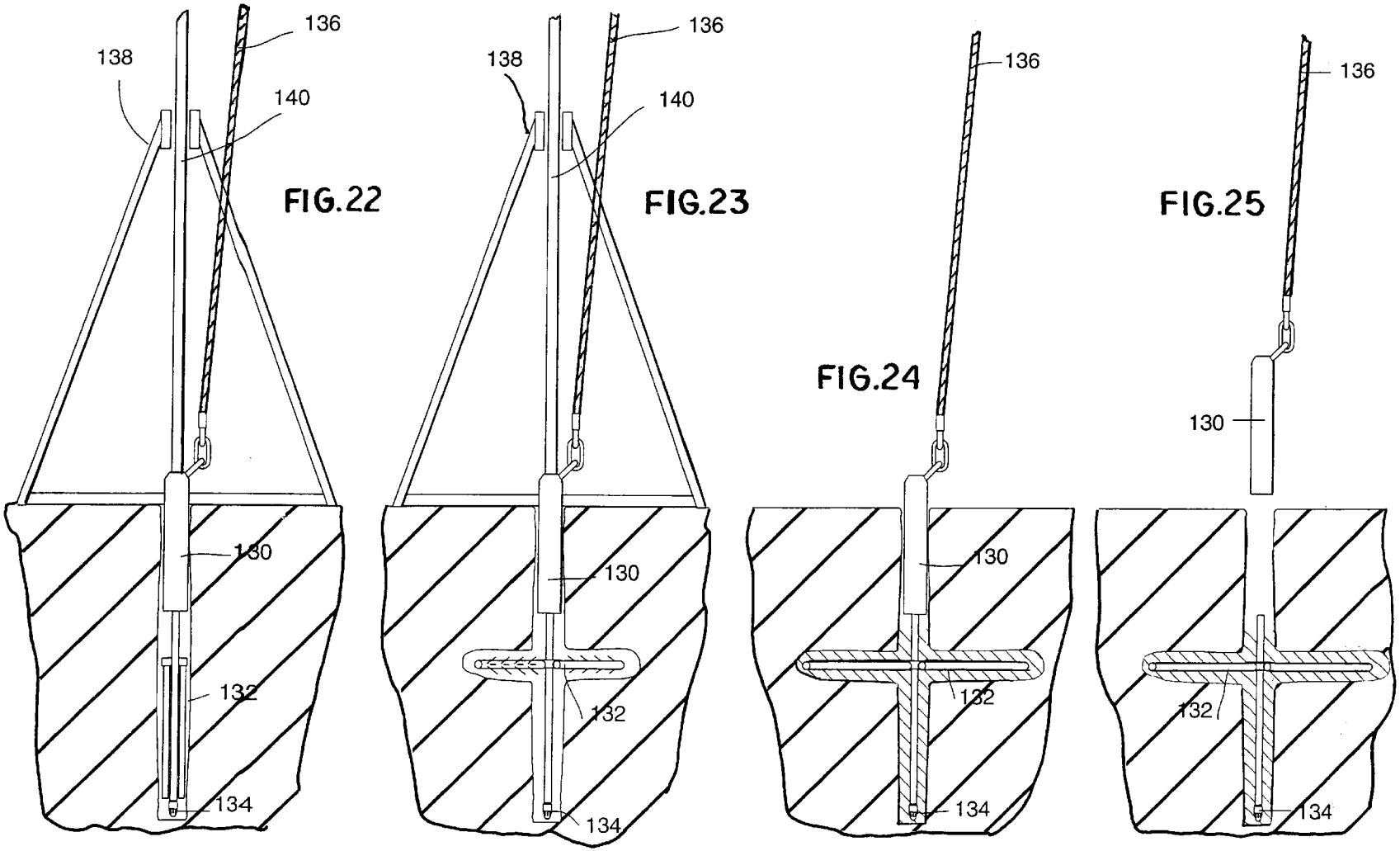
FIGS. 22 to 25 show a further embodiment in operation.
Figures 26, 27, 28, 29:
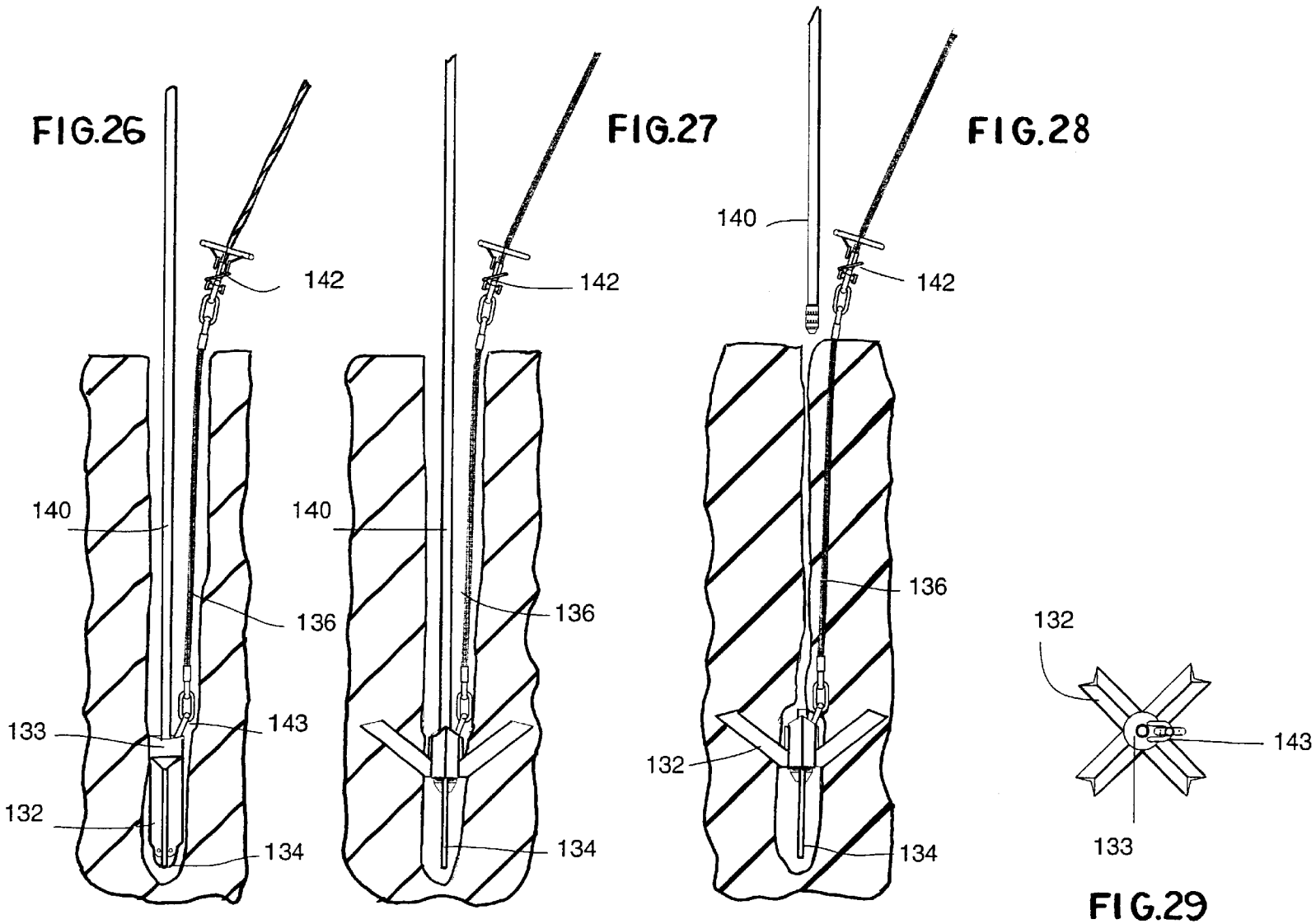
FIGS. 26 to 34 show a further embodiment in operation.
Figure 30:
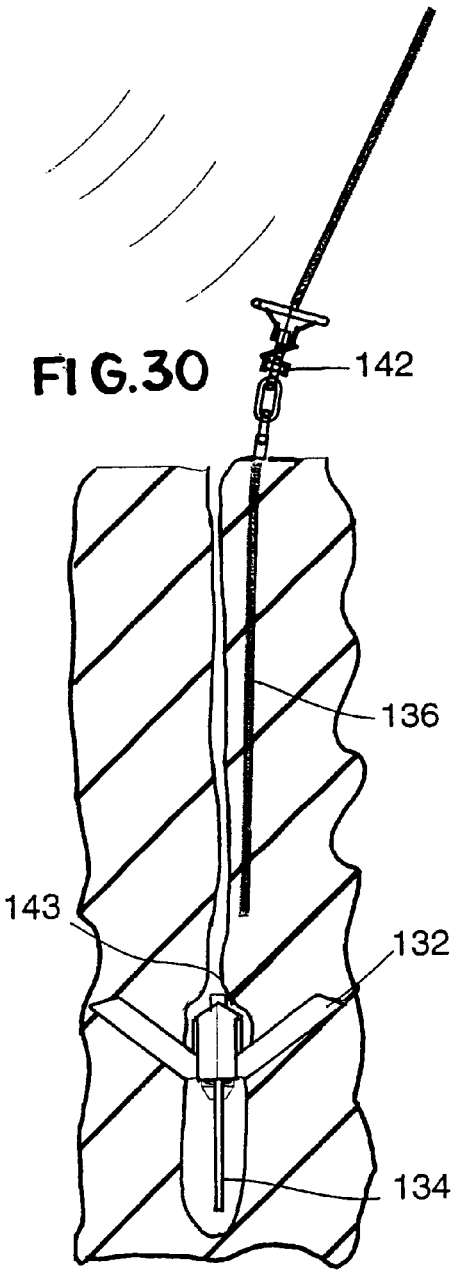
Figure 31:
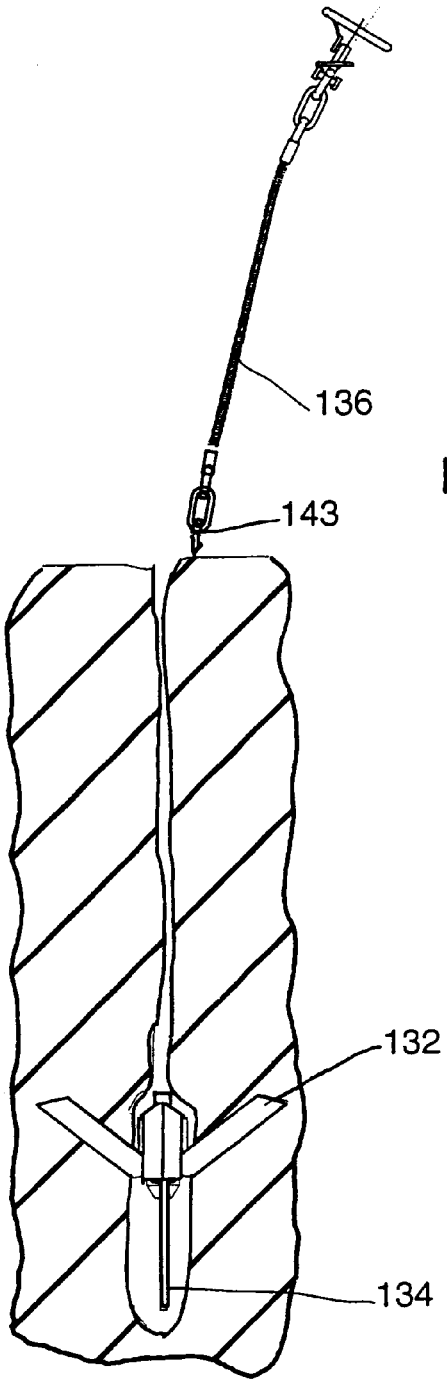

When the required depth has been reached, the valve means associated with the nozzle 134 reduce or stop the water supply to that nozzle, and the outer rods are caused to pivot upwards until horizontal, so that the three rods form a cross, as shown in FIG. 23. This may be achieved by water pressure supplied from the water supply, or by some independent means. The outer rods have a set of small nozzles along one side, the set of nozzles upon one rod being on the opposite side to those of the other rod. Once the outer rods are horizontal, the valve means direct water through these nozzles. The expulsion of the water from these nozzles cause them to rotate with the central rod about axis of the central rod, so :that the outer rods cut a cavity resembling a horizontal disc.

When one revolution has been performed, cement is pumped through the coiled tubing, the valve cleans directing it through the nozzle 134 so that it displaces all the water in the cavity, When the cement has set, the mooring apparatus is firmly embedded in the seabed. The coiled tubing and supporting fame may be removed as soon as the mooring apparatus is firmly enough embedded, which will to some degree depend upon the material which makes up the seabed.

The outer rods may of course be extended through an angle greater than 90 degrees, so that a conical cavity is formed, In this case, cement should also be passed through the nozzles of the outer rods to ensure no water pockets form as the cement is being injected into the cavity. The rods, or indeed other parts of the mooring apparatus, may feature projections such as spikes along their length to ensure that the cement adheres firmly to the mooring apparatus.

In this embodiment, the securement members cannot easily be retrieved, so the mooring post is detached from the mooring apparatus by a signal, sent by sonic pulses or cable means, and retrieved upon the mooring line.

Another embodiment is shown in FIGS. 26 to 34, The mooring apparatus, attached to the end of some coiled tubing 140, is lowered to the seabed and thence to the required depth beneath the seabed (which could be up to several hundred meters, a nozzle 134 supplied with water from the coiled tubing eroding the seabed to create a shaft in front of the apparatus as it descends. In this embodiment there is no mooring post as such, but the coiled tubing is attached to hub 133 from which the securement members 132 and the nozzle 134 extend. The securement members comprise four slats, each hinged about the hub at 90 degree intervals, and initially extending downwards. The nozzle is tubular and extends somewhat beyond the end of the securement members. At the correct depth, valve means close the supply to the nozzle, and the slats are caused to pivot upwards so that in plan they form a cross, this being shown in FIG. 29.

In their final position, the slats have been pivoted through around 120 degrees, so that as the mooring line pulls upon the mooring apparatus the securement members present a very unstreamlined shape. In cross section each slat has a V-shape, the apex of which points downwards, this shape contributing to the unstreamlined nature of the securement members. The slats may have nozzles upon them, either to drive them upwards, or to ease their journey through the material of the seabed. Cement is now pumped through the coiled tubing, and injected by the nozzle into the cavity around the mooring apparatus, The coiled tubing may be removed when the cement is sufficiently cured.

Figures 32, 33, 34:
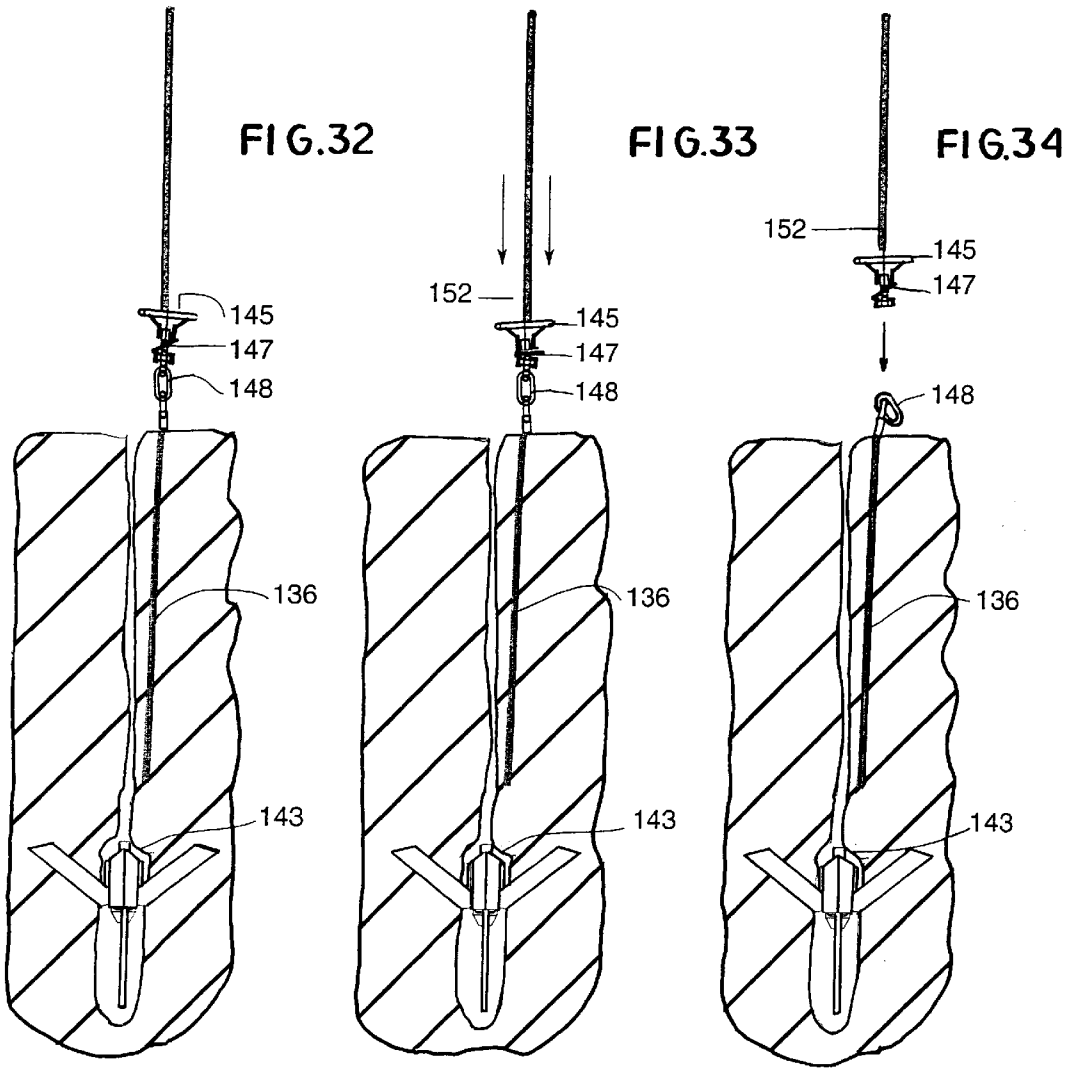

The mooring line 136 is connected to the mooring apparatus by a link 143. When the mooring point is no longer required, the mooring line can be disconnected from the hub by means of a signal transmitted to the mooring apparatus, by sonic pulses for example, causing the link 143 at the end of the mooring line to be released. If this procedure fails for some reason, a catch 142 is provided part of the way along the mooring line, so that when the mooring apparatus is embedded, the catch is somewhat above the surface of the seabed. Referring to FIGS. 32 to 34 in particular, a supply vessel can take the mooring line so that it is directly above the mooring apparatus, and pulling the mooring line taut, release a heavy annular ring 152 so that it descends along the mooring line 136, When the annular ring strikes the catch's platform 145, a switch 147 releases a link 148, so that the majority of the mooring line may be recovered.

Many variations will be apparent to those skilled in the art, such as using other well known methods of attaching an anchor to the seabed, for instance the anchor may be a suction pile, or the anchor may be driven into the seabed using a charge. Naturally, features disclosed in respect of one embodiment may be transferable to the other embodiments.

Although the mooring apparatus is primarily intended for the securement of floating rigs, it can be used whenever anchor points upon the seabed are require It may also be incorporated into other underwater apparatus.

Alternative embodiments using the principles disclosed will suggest themselves to those skilled in the art, and it is intended that such alternatives are included within the scope of the invention, the scope of the invention being limited only by the claims.

What is claimed is:

1. A mooring apparatus comprising:

a sea-bed penetrator adapted to penetrate into a sea bed to a depth sufficient to moor a floating structure;

a device connected to said penetrator for securing a mooring line thereto;

a coiled tubing adapted to be fed from above sea level on a vessel other than said structure toward said sea bed and serving to supply said sea-bed penetrator; and a releasable coupling between said coiled tubing and said sea-bed penetrator for detaching said coiled tubing from said seabed penetrator upon anchoring said sea-bed penetrator and said device to said sea bed so that said mooring line forms the sole link between said floating structure and said sea-bed penetrator.

2. The mooring apparatus defined in claim 1 wherein said sea-bed penetrator comprises a fluid-operated penetrating device actuated by fluid supplied through said coiled tubing.

3. The mooring apparatus defined in claim 1 wherein said device is actuated by fluid supplied through said coiled tubing.

4. The mooring apparatus defined in claim 1, further comprising a transmission cable extending through said coiled tubing.

5. The mooring apparatus defined in claim 1 wherein said sea-bed penetrator includes a helical element which screws into the sea bed actuated by power supplied through said coiled tubing.

6. The mooring apparatus defined in claim 1 wherein said sea-bed penetrator is a drill bit actuated by power supplied through said coiled tubing.

7. The mooring apparatus defined in claim 1 wherein said device is provided with means releasably engaged by said mooring line.

8. The mooring apparatus defined in claim 1, further comprising a buoy releasably attached to said penetrator and storing a guide line whereby said buoy is released when said guide line is needed for securing said mooring line to said device.

9. The mooring apparatus defined in claim 1, further comprising a connector between said buoy and said penetrator operable by a remote signal to release said buoy.

10. The mooring apparatus defined in claim 1 wherein said sea-bed penetrator includes at least one nozzle for discharging fluid to erode the sea bed.

11. The mooring apparatus defined in claim 1 wherein said sea-bed penetrator includes means for delivering an adhesive supplied by said tubing into a cavity formed in said sea bed.

12. A method of mooring a floating structure to a sea bed, comprising the steps of:

a) feeding from a vessel other than said structure a coiled tubing downwardly toward said sea bed and having at an end thereof a sea-bed penetrator powered through said coiled tubing to cause said sea-bed penetrator to penetrate into said sea bed to a depth sufficient to moor said floating structure thereto, said seabed penetrator being provided with a device to which a mooring line can be secured;

b) upon anchoring of said device to said sea bed by said sea-bed penetrator detaching said coiled tubing therefrom; and c) securing said mooring line to said device and winching said mooring line on said structure whereby said mooring line forms the sole link between said floating structure and said sea-bed penetrator.

13. The method defined in claim 12 wherein in step b) a buoy on said sea-bed penetrator and storing a guide line is released by a remote signal to carry said guide line to a surface of the sea above the sea bed and said guide line is pulled to draw said mooring line to said device.

14. The method defined in claim 12 wherein said sea-bed penetrator includes a drill adapted to form a chamber in said sea bed, further comprising the step of introducing into said chamber an adhesive through said coiled tubing.

* * * * *